US008385804B2

(12) United States Patent
Yamaguchi et al.

(10) Patent No.: US 8,385,804 B2
(45) Date of Patent: Feb. 26, 2013

(54) FIXING DEVICE AND IMAGE FORMING APPARATUS EMPLOYING THE FIXING DEVICE

(75) Inventors: Yoshiki Yamaguchi, Sagamihara (JP); Kenichi Hasegawa, Atsugi (JP); Masaaki Yoshikawa, Setagaya-ku (JP); Hiroshi Yoshinaga, Ichikawa (JP); Kenji Ishii, Kawasaki (JP); Akira Shinshi, Machida (JP); Naoki Iwaya, Chofu (JP); Tetuso Tokuda, Kawasaki (JP); Ippei Fujimoto, Ebina (JP); Yutaka Ikebuchi, Chigasaki (JP); Shuntaroh Tamaki, Kawasaki (JP); Takahiro Imada, Yokohama (JP); Takamasa Hase, Kawasaki (JP); Toshihiko Shimokawa, Zama (JP)

(73) Assignee: Ricoh Company, Limited, Tokyo (JP)

( * ) Notice: Subject to any disclaimer, the term of this patent is extended or adjusted under 35 U.S.C. 154(b) by 290 days.

(21) Appl. No.: 12/878,480

(22) Filed: Sep. 9, 2010

(65) Prior Publication Data

US 2011/0058862 A1 Mar. 10, 2011

(30) Foreign Application Priority Data

Sep. 10, 2009 (JP) ..... 2009-208801

(51) Int. Cl.
*G03G 15/20* (2006.01)

(52) U.S. Cl. ..... 399/329

(58) Field of Classification Search ..... 399/329, 399/328, 122

See application file for complete search history.

(56) References Cited

U.S. PATENT DOCUMENTS

| | | | | |
|---|---|---|---|---|
| 6,029,040 | A * | 2/2000 | Yamada et al. | 399/325 |
| 6,131,009 | A | 10/2000 | Hasegawa | |
| 6,496,666 | B2 | 12/2002 | Hayashi et al. | |
| 6,591,081 | B2 | 7/2003 | Hasegawa | |
| 6,628,916 | B2 | 9/2003 | Yasui et al. | |

(Continued)

FOREIGN PATENT DOCUMENTS

| | | | |
|---|---|---|---|
| CN | 1704854 | A | 12/2005 |
| CN | 101109924 | A | 1/2008 |

(Continued)

OTHER PUBLICATIONS

Office Action issued Aug. 23, 2012 in Chinese Patent Application No. 201010277147.7.

*Primary Examiner* — Walter L Lindsay, Jr.
*Assistant Examiner* — Rodney Bonnette
(74) *Attorney, Agent, or Firm* — Oblon, Spivak, McClelland, Maier & Neustadt, L.L.P.

(57) ABSTRACT

A fixing device includes an endless, flexible fixing member, a metal member, a heater, a pressing member, a temperature detector, and a supporting member. The fixing member is rotatably provided in the fixing device to heat a toner image thereon. The metal member is fixedly mounted in the fixing device so as to be opposite an inner circumferential surface of the fixing member, to maintain the fixing member in a substantially circularly loop shape. The heater is disposed near the metal member to heat the metal member. The pressing member is rotatably pressed against an outer circumferential surface of the fixing member to form a nip portion between the pressing member and the fixing member. The temperature detector is disposed in contact with the metal member, to detect a temperature of the metal member. The supporting member is disposed between the heater and the temperature detector to support the temperature detector.

13 Claims, 4 Drawing Sheets

U.S. PATENT DOCUMENTS 6,636,709 B2 10/2003 Furukawa et al.
6,778,790 B2 8/2004 Yoshinaga et al.
6,778,804 B2 8/2004 Yoshinaga et al.
6,785,505 B2 8/2004 Yasui et al.
6,813,464 B2 11/2004 Amita et al.
6,864,461 B2 * 3/2005 Okabayashi et al. ..... 219/216
6,881,927 B2 4/2005 Yoshinaga et al.
6,882,820 B2 4/2005 Shinshi et al.
6,892,044 B2 5/2005 Yasui et al.
6,937,827 B2 8/2005 Katoh et al.
7,022,944 B2 4/2006 Yoshinaga et al.
7,070,182 B2 7/2006 Hasegawa
7,127,204 B2 10/2006 Satoh et al.
7,151,907 B2 12/2006 Yoshinaga
7,239,838 B2 7/2007 Sato et al.
7,242,897 B2 7/2007 Satoh et al.
7,313,353 B2 12/2007 Satoh et al.
7,330,682 B2 2/2008 Shinshi
7,379,698 B2 5/2008 Yoshinaga
7,454,151 B2 11/2008 Satoh et al.
7,466,949 B2 12/2008 Satoh et al.
7,509,085 B2 3/2009 Yoshinaga et al.
7,515,850 B2 4/2009 Hasegawa
7,546,049 B2 6/2009 Ehara et al.
7,570,910 B2 8/2009 Ishii
7,593,680 B2 9/2009 Shinshi
7,630,652 B2 12/2009 Hasegawa
7,742,714 B2 6/2010 Shinshi et al.
7,783,240 B2 8/2010 Ito et al.
8,219,016 B2 7/2012 Hasegawa et al.
2005/0265758 A1 12/2005 Haseba et al.
2006/0029411 A1 2/2006 Ishii et al.
2006/0257183 A1 11/2006 Ehara et al.
2007/0003334 A1 1/2007 Shinshi et al.
2007/0014600 A1 1/2007 Ishii et al.
2007/0059071 A1 3/2007 Shinshi et al.
2007/0071523 A1 3/2007 Suzuki
2007/0292175 A1 12/2007 Shinshi
2008/0002996 A1 1/2008 Ushiro
2008/0063443 A1 3/2008 Yoshinaga et al.
2008/0112739 A1 5/2008 Shinshi
2008/0175633 A1 7/2008 Shinshi
2008/0219730 A1 9/2008 Shinshi
2008/0226326 A1 9/2008 Seo et al.
2008/0232873 A1 9/2008 Ueno et al.
2008/0253788 A1 10/2008 Shinshi
2008/0253789 A1 10/2008 Yoshinaga et al.
2008/0298862 A1 12/2008 Shinshi
2008/0317532 A1 12/2008 Ehara et al.
2009/0003867 A1 1/2009 Fujimoto
2009/0067902 A1 3/2009 Yoshinaga et al.
2009/0123201 A1 5/2009 Ehara et al.
2009/0123202 A1 5/2009 Yoshinaga et al.
2009/0148204 A1 6/2009 Yoshinaga et al.
2009/0148205 A1 6/2009 Seo et al.
2009/0169232 A1 7/2009 Kunii et al.
2009/0245865 A1 10/2009 Shinshi et al.
2009/0245897 A1 10/2009 Seo et al.
2009/0263170 A1 * 10/2009 Kagawa et al. ..... 399/329
2009/0297197 A1 12/2009 Hase
2009/0311016 A1 12/2009 Shinshi
2010/0061753 A1 3/2010 Hase
2010/0074667 A1 3/2010 Ehara et al.
2010/0092220 A1 4/2010 Hasegawa et al.
2010/0092221 A1 4/2010 Shinshi et al.
2010/0142987 A1 * 6/2010 Sato ..... 399/69
2010/0202809 A1 8/2010 Shinshi et al.
2010/0303521 A1 12/2010 Ogawa et al.
2011/0026987 A1 2/2011 Hasegawa
2011/0026988 A1 2/2011 Yoshikawa et al.

FOREIGN PATENT DOCUMENTS

CN 101192040 A 6/2008
JP 4-122969 4/1992
JP 2002-49272 2/2002
JP 2007-79171 3/2007
JP 2008-146010 6/2008
JP 2009-3410 1/2009

* cited by examiner

FIXING DEVICE AND IMAGE FORMING APPARATUS EMPLOYING THE FIXING DEVICE

CROSS-REFERENCE TO RELATED APPLICATIONS

The present patent application claims priority pursuant to 35 U.S.C. §119 from Japanese Patent Application No. 2009-208801, filed on Sep. 10, 2009 in the Japan Patent Office, which is incorporated herein by reference in its entirety.

BACKGROUND OF THE DISCLOSURE

1. Field of the Disclosure

Exemplary embodiments of the present disclosure relate to a fixing device and an image forming apparatus including the fixing device, and more specifically, to a fixing device that applies heat and pressure to a recording medium at a nip formed between a fixing member and a pressing member to fix an image on the recording medium, and an image forming apparatus including the fixing device.

2. Description of the Background

Related-art image forming apparatuses, such as copiers, facsimile machines, printers, or multifunction apparatuses having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such fixing device may include a cylindrical metal member to heat the fixing device effectively to shorten a warm-up time or a time to first print (hereinafter also "first print time"). Specifically, the metal member provided inside a loop into which an endless fixing belt is formed, facing the inner circumferential surface of the fixing belt. The metal member is heated by a built-in or external heater so as to heat the fixing belt. A pressing roller presses against the outer circumferential surface of the fixing belt at a position corresponding to the location of the metal member inside the loop formed by the fixing belt to form a nip between the fixing belt and the pressing roller through which the recording medium bearing the toner image passes. As the recording medium bearing the toner image passes through the nip, the fixing belt and the pressing roller apply heat and pressure to the recording medium to fix the toner image on the recording medium.

To maintain a desired surface temperature (fixing temperature) of the fixing belt, a contact-type temperature sensor (temperature detector) is provided at the outer circumferential surface of the fixing belt. The heater is turned on and off in accordance with detection results of the temperature sensor.

For example, JP-2008-146010-A proposes a fixing device including a temperature sensor (temperature detector) to detect a temperature of the fixing belt. In this case, the temperature sensor is pressed against an inner circumferential surface of a metal member and a resistant heat generator serving as a heater.

Further, JP-2009-003410-A proposes a fixing device including a stationary member (contact member) against which the pressing roller is pressed to form a nip portion and a reinforcement member to reinforce the stationary member.

In the above-described fixing devices, because the contact-type temperature sensor (thermistor) is disposed in contact with the outer circumferential surface of the fixing belt, the outer circumferential surface of the fixing belt gets worn and deteriorates, which might cause a degraded fixing image. In particular, if the fixing belt is not reliably maintained in a substantially circular loop, the contact-type temperature sensor needs to be pressed against the fixing belt with a relatively large pressing force to ensure reliable contact with the fixing belt, which may make the above-described challenge non-negligible.

To deal with such a challenge, it is conceivable to use a non-contact-type temperature sensor, such as a thermopile. However, such a non-contact-type temperature sensor may be quite expensive. Moreover, if the contact-type temperature sensor is disposed at a non-sheet-pass area of the fixing belt, that is, an area of the fixing belt over which a recording sheet is not usually conveyed in the course of normal image formation, then the size of the fixing device is enlarged laterally. A similar outcome occurs if the temperature sensor is disposed at the outer circumferential surface side of the fixing belt, in which case the fixing device is enlarged radially.

To deal with such challenges, it is conceivable to locate the temperature sensor inside the pipe-shaped metal member. In such a case, however, it is unclear whether the surface temperature of the fixing belt can be detected with high sensitivity and precision. Further, with such a configuration, the temperature sensor might be directly heated by the heater disposed inside the pipe-shaped metal member, damaging the temperature sensor.

SUMMARY

In at least one exemplary embodiment, there is provided an improved fixing device including an endless, flexible fixing member, a metal member, a heater, a pressing member, a temperature detector, and a supporting member. The fixing member is rotatably provided in the fixing device to heat a toner image thereon. The metal member is fixedly mounted in the fixing device so as to be opposite an inner circumferential surface of the fixing member, to maintain the fixing member in a substantially circularly loop shape. The heater is disposed near the metal member to heat the metal member. The pressing member is rotatably pressed against an outer circumferential surface of the fixing member to form a nip portion between the pressing member and the fixing member. The temperature detector is disposed in contact with the metal member, to detect a temperature of the metal member. The supporting member is disposed between the heater and the temperature detector to support the temperature detector.

In at least one exemplary embodiment, there is provided an improved image forming apparatus including the fixing device described above. The fixing device includes an endless, flexible fixing member, a metal member, a heater, a pressing member, a temperature detector, and a supporting member.

BRIEF DESCRIPTION OF THE DRAWINGS

Additional aspects, features, and advantages of the present disclosure will be readily ascertained as the same becomes better understood by reference to the following detailed description when considered in connection with the accompanying drawings, wherein.

Figure 1:
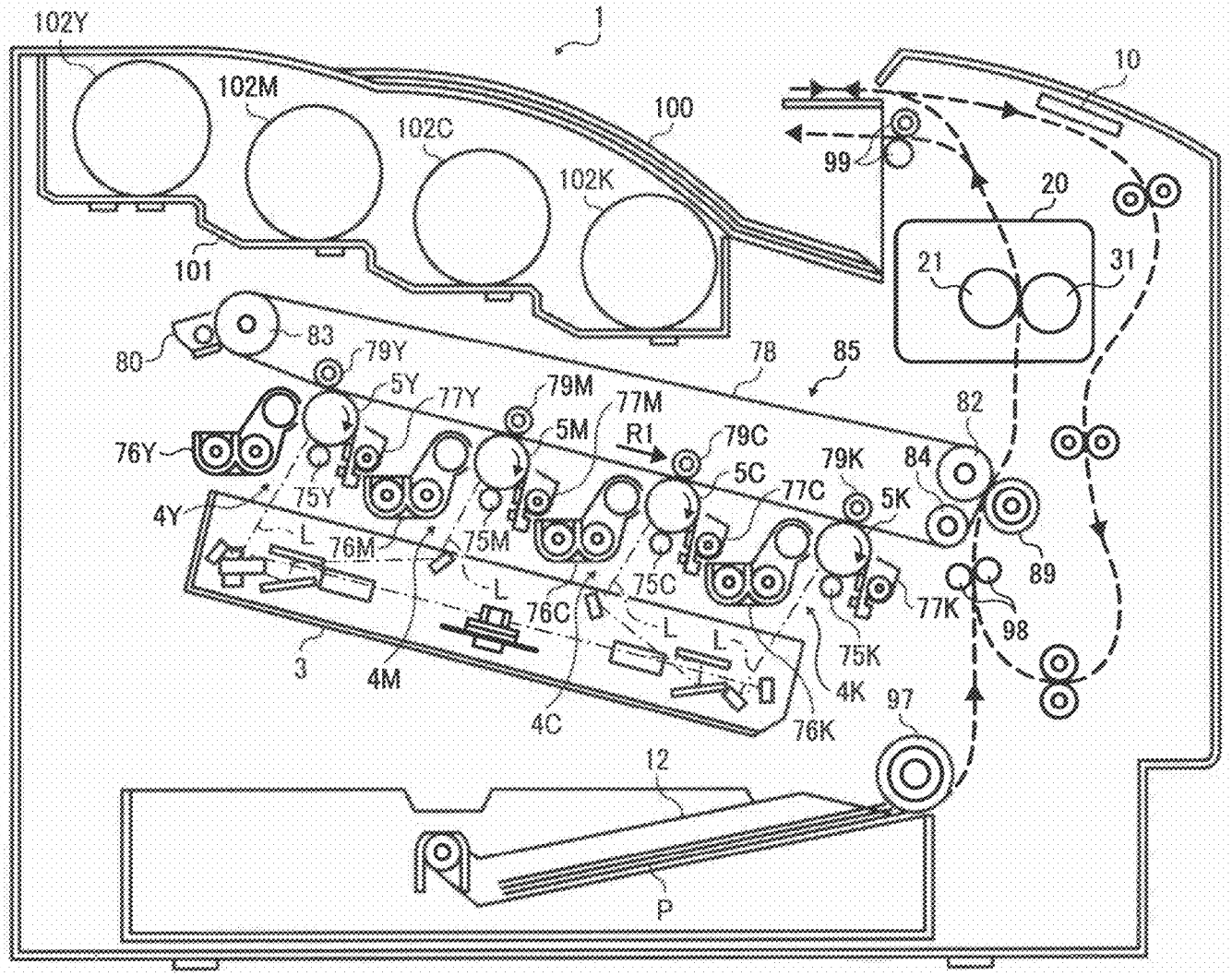
FIG. 1 is a schematic view of an image forming apparatus according to an exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

It is to be noted that, in the description below, reference characters Y, M, C, and K attached to the end of each reference numeral indicate only that components indicated thereby are used for forming yellow, magenta, cyan, and black images, respectively, and hereinafter may be omitted when color discrimination is not necessary.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic view of the image forming apparatus 1. As illustrated in FIG. 1, the image forming apparatus 1 may be a copier, a facsimile machine, a printer, a multifunction printer having at least one of copying, printing, scanning, plotter, and facsimile functions, or the like. According to this exemplary embodiment of the present invention, the image forming apparatus 1 is a tandem color printer for forming a color image on a recording medium.

As illustrated in FIG. 1, the image forming apparatus 1 includes an exposure device 3, image forming devices 4Y, 4M, 4C, and 4K, a controller 10, a paper tray 12, a fixing device 20, an intermediate transfer unit 85, a second transfer roller 89, a feed roller 97, a registration roller pair 98, an output roller pair 99, a stack portion 100, and a toner bottle holder 101.

The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, and cleaners 77Y, 77M, 77C, and 77K, respectively.

The fixing device 20 includes a fixing belt 21 and a pressing roller 31.

The intermediate transfer unit 85 includes an intermediate transfer belt 78, first transfer bias rollers 79Y, 79M, 79C, and 79K, an intermediate transfer cleaner 80, a second transfer backup roller 82, a cleaning backup roller 83, and a tension roller 84.

The toner bottle holder 101 includes toner bottles 102Y, 102M, 102C, and 102K.

The toner bottle holder 101 is provided in an upper portion of the image forming apparatus 1. The four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

The intermediate transfer unit 85 is provided below the toner bottle holder 101. The image forming devices 4Y, 4M, 4C, and 4K are arranged opposite the intermediate transfer belt 78 of the intermediate transfer unit 85, and form yellow, magenta, cyan, and black toner images, respectively.

In the image forming devices 4Y, 4M, 4C, and 4K, the chargers 75Y, 75M, 75C, and 75K, the development devices 76Y, 76M, 76C, and 76K, the cleaners 77Y, 77M, 77C, and 77K, and dischargers surround the photoconductive drums 5Y, 5M, 5C, and 5K, respectively. Image forming processes including a charging process, an exposure process, a development process, a transfer process, and a cleaning process are performed on the photoconductive drums 5Y, 5M, 5C, and 5K to form yellow, magenta, cyan, and black toner images on the photoconductive drums 5Y, 5M, 5C, and 5K, respectively.

A driving motor drives and rotates the photoconductive drums 5Y, 5M, 5C, and 5K clockwise in FIG. 1. In the charging process, the chargers 75Y, 75M, 75C, and 75K uniformly charge surfaces of the photoconductive drums 5Y, 5M, 5C, and 5K at charging positions at which the chargers 75Y, 75M, 75C, and 75K are disposed opposite the photoconductive drums 5Y, 5M, 5C, and 5K, respectively.

In the exposure process, the exposure device 3 emits laser beams L onto the charged surfaces of the photoconductive drums 5Y, 5M, 5C, and 5K, respectively. In other words, the exposure device 3 scans and exposes the charged surfaces of the photoconductive drums 5Y, 5M, 5C, and 5K at irradiation positions at which the exposure device 3 is disposed opposite the photoconductive drums 5Y, 5M, 5C, and 5K to irradiate the charged surfaces of the photoconductive drums 5Y, 5M, 5C, and 5K to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images at development positions at which the development devices 76Y, 76M, 76C, and 76K are disposed opposite the photoconductive drums 5Y, 5M, 5C, and 5K, respectively.

In the transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78 at first transfer positions at which the first transfer bias rollers 79Y, 79M, 79C, and 79K are disposed opposite the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

In the cleaning process, cleaning blades included in the cleaners 77Y, 77M, 77C, and 77K mechanically collect the residual toner from the photoconductive drums 5Y, 5M, 5C, and 5K at cleaning positions at which the cleaners 77Y, 77M, 77C, and 77K are disposed opposite the photoconductive drums 5Y, 5M, 5C, and 5K, respectively.

Finally, dischargers remove residual potential on the photoconductive drums 5Y, 5M, 5C, and 5K at discharging positions at which the dischargers are disposed opposite the photoconductive drums 5Y, 5M, 5C, and 5K, respectively, thus completing a single sequence of image forming processes performed on the photoconductive drums 5Y, 5M, 5C, and 5K.

The intermediate transfer belt 78 is supported by and stretched over three rollers, which are the second transfer backup roller 82, the cleaning backup roller 83, and the tension roller 84. A single roller, that is, the second transfer backup roller 82, drives and endlessly moves (e.g., rotates) the intermediate transfer belt 78 in a direction R1.

The four first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite to a polarity of toner forming the yellow, magenta, cyan, and black toner images on the photoconductive drums 5Y, 5M, 5C, and 5K, respectively. Accordingly, the yellow, magenta, cyan, and black toner images formed on the photoconductive drums 5Y, 5M, 5C, and 5K, respectively, are transferred and superimposed onto the intermediate transfer belt 78 rotating in the direction R1 successively at the first transfer nips formed between the photoconductive drums 5Y, 5M, 5C, and 5K and the intermediate transfer belt 78 as the intermediate transfer belt 78 moves through the first transfer nips. Thus, a color toner image is formed on the intermediate transfer belt 78.

The paper tray 12 is provided in a lower portion of the image forming apparatus 1, and loads a plurality of recording media P (e.g., transfer sheets). The feed roller 97 rotates counterclockwise in FIG. 1 to feed an uppermost recording medium P of the plurality of recording media P loaded on the paper tray 12 toward a roller nip formed between two rollers of the registration roller pair 98.

The registration roller pair 98, which stops rotating temporarily, stops the uppermost recording medium P fed by the feed roller 97 and reaching the registration roller pair 98. For example, the roller nip of the registration roller pair 98 contacts and stops a leading edge of the recording medium P. The registration roller pair 98 resumes rotating to feed the recording medium P to a second transfer nip, formed between the second transfer roller 89 and the intermediate transfer belt 78, as the color toner image formed on the intermediate transfer belt 78 reaches the second transfer nip.

At the second transfer nip, the second transfer roller 89 and the second transfer backup roller 82 sandwich the intermediate transfer belt 78. The second transfer roller 89 transfers the color toner image formed on the intermediate transfer belt 78 onto the recording medium P fed by the registration roller pair 98 at the second transfer nip formed between the second transfer roller 89 and the intermediate transfer belt 78. Thus, the desired color toner image is formed on the recording medium P. After the transfer of the color toner image, residual toner, which has not been transferred onto the recording medium P, remains on the intermediate transfer belt 78.

The intermediate transfer cleaner 80 collects the residual toner from the intermediate transfer belt 78 at a cleaning position at which the intermediate transfer cleaner 80 is disposed opposite the intermediate transfer belt 78, thus completing a single sequence of transfer processes performed on the intermediate transfer belt 78.

The recording medium P bearing the color toner image is sent to the fixing device 20. In the fixing device 20, the fixing belt 21 and the pressing roller 31 apply heat and pressure to the recording medium P to fix the color toner image on the recording medium P.

Thereafter, the fixing device 20 feeds the recording medium P bearing the fixed color toner image toward the output roller pair 99. The output roller pair 99 discharges the recording medium P to an outside of the image forming apparatus 1, that is, the stack portion 100. Thus, the recording media P discharged by the output roller pair 99 are stacked on the stack portion 100 successively to complete a single sequence of image forming processes performed by the image forming apparatus 1.

The controller 10 controls operation of the components of the image forming apparatus 1.

Referring to FIGS. 2 to 5, the following describes the structure and operation of the fixing device 20.

Figure 2:
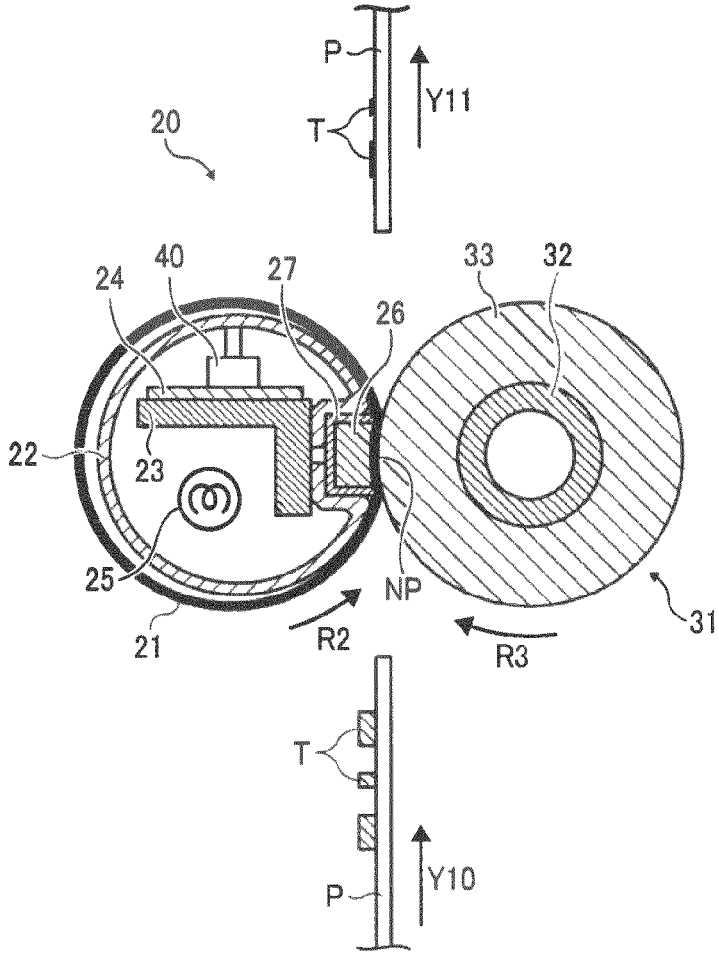
FIG. 2 is a sectional view of a fixing device included in the image forming apparatus shown in FIG. 1.

FIG. 2 is a sectional view of the fixing device 20. As illustrated in FIG. 2, the fixing device 20 further includes a metal member 22, a reinforcement member 23, a heater 25, a stationary member 26, a heat insulator 27, and a temperature sensor 40. The pressing roller 31 includes a metal core 32 and an elastic layer 33.

Figure 3:
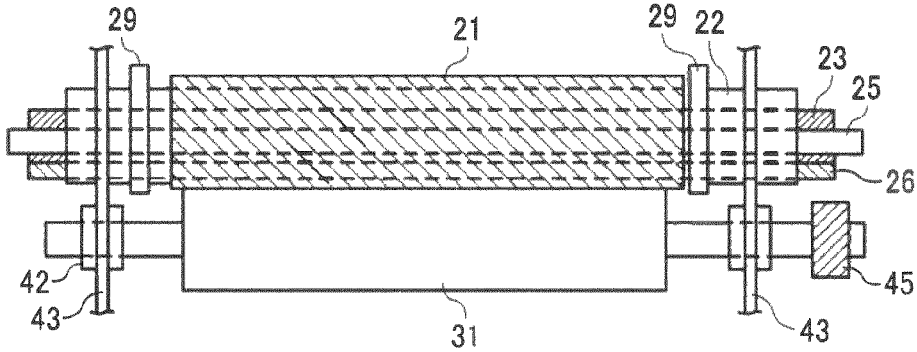
FIG. 3 is a plan view of the fixing device shown in FIG. 2.

FIG. 3 is a plan view of the fixing device 20. As illustrated in FIG. 3, the fixing device 20 further includes flanges 29, bearings 42, side plates 43, a gear 45, a cooling fan 61, and a duct 62.

Figure 4:
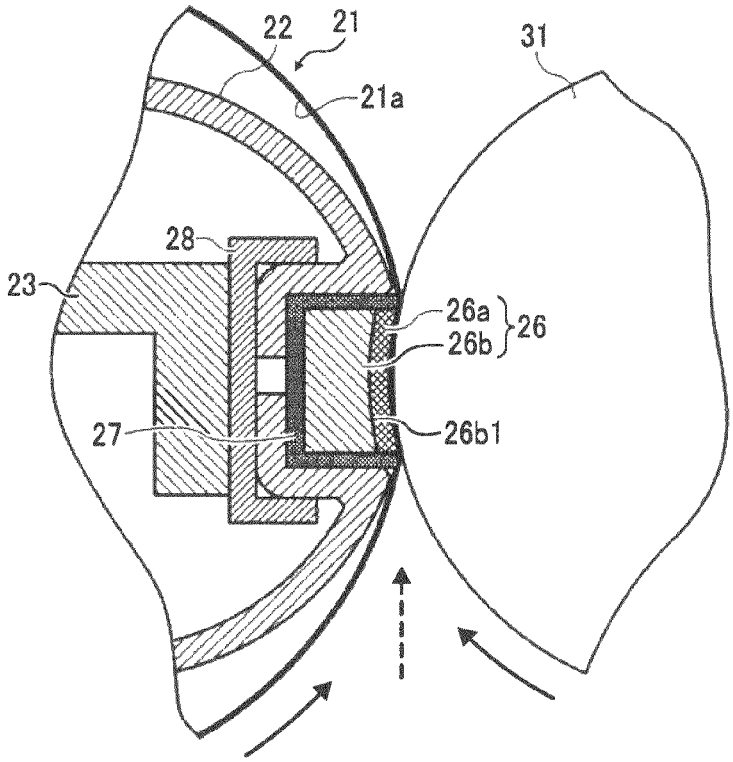
FIG. 4 is an enlarged view of a fixing nip and its neighboring area of the fixing device shown in FIG. 2.

FIG. 4 is a partially enlarged sectional view of the fixing device 20. As illustrated in FIG. 4, the fixing device 20 further includes a stay 28. The fixing belt 21 includes an inner circumferential surface 21*a*. The stationary member 26 includes a surface layer 26*a* and a base layer 26*b*.

Figure 5:
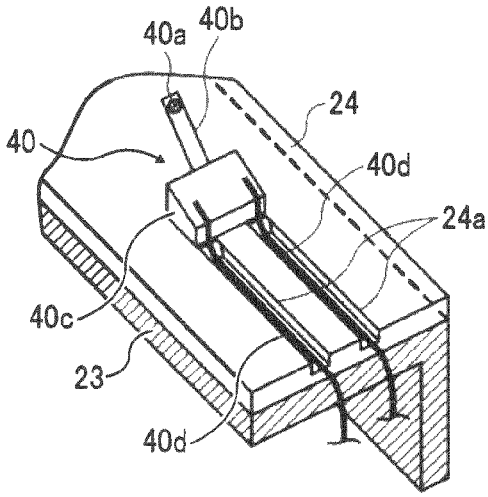
FIG. 5 is a perspective view illustrating a configuration of a temperature sensor supported on a reinforcement member (supporting member)

FIG. 5 is a perspective view illustrating a temperature sensor 40 supported by a reinforcement member (supporting member) 23.

As illustrated in FIGS. 2 and 4, the fixing device 20 includes the fixing belt 21 serving as a fixing member or a belt member, the stationary member 26, the metal member 22 serving as a heating member, the reinforcement member 23 serving as a supporting member, a heat insulation member 24, the heater 25 serving as a heater or a heat source, the pressing roller 31 serving as a rotary pressing member, the temperature sensor 40 serving as a temperature detection unit, the heat insulator 27, and the stay 28.

The fixing belt 21 serving as a fixing member may be a thin, flexible endless belt that rotates or moves counterclockwise in FIG. 2 in a rotation direction R2. The fixing belt 21 is constructed of a base layer, an intermediate elastic layer, and a surface release layer, and has a total thickness not greater than about 1 mm. The base layer includes the inner circumferential surface 21*a* serving as a sliding surface which slides over the stationary member 26. The elastic layer is provided on the base layer. The release layer is provided on the elastic layer.

The base layer of the fixing belt 21 has a thickness in a range of from about 30 μm to about 50 μm, and includes a metal material such as nickel and/or stainless steel, and/or a resin material such as polyimide.

The elastic layer of the fixing belt 21 has a thickness in a range of from about 100 μm to about 300 μm, and includes a rubber material such as silicon rubber, silicon rubber foam, and/or fluorocarbon rubber. The elastic layer eliminates or reduces slight surface asperities of the fixing belt 21 at a nip NP formed between the fixing belt 21 and the pressing roller 31. Accordingly, heat is uniformly transmitted from the fixing belt 21 to a toner image T on a recording medium P, suppressing formation of a rough image such as an orange peel image.

The release layer of the fixing belt 21 has a thickness in a range of from about 10 μm to about 50 μm, and includes tetrafluoroethylene-perfluoroalkylvinylether copolymer (PFA), polytetrafluoroethylene (PTFE), polyimide, polyetherimide, and/or polyether sulfide (PES). The release layer releases or separates the toner image T from the fixing belt 21.

The fixing belt 21 has a loop diameter in a range of from about 15 mm to about 120 mm. According to this exemplary embodiment, the fixing belt 21 has an inner diameter of about 30 mm. As illustrated in FIGS. 2 and 4, the stationary member 26, the heater 25, the metal member 22, the reinforcement member (supporting member) 23, the heat insulation member 24, the temperature sensor (temperature detection unit) 40, the heat insulator 27, and the stay 28 are fixedly provided inside a loop formed by the fixing belt 21. In other words, the stationary member 26, the heater 25, the metal member 22, the reinforcement member 23, the heat insulator 27, and the stay 28 do not face an outer circumferential surface of the fixing belt 21, but face the inner circumferential surface 21*a* of the fixing belt 21.

The stationary member 26 is fixed inside the fixing belt 21 in such a manner that the inner circumferential surface 21*a* of the fixing belt 21 slides over the stationary member 26. The stationary member 26 presses against the pressing roller 31 via the fixing belt 21 to form the nip NP between the fixing belt 21 and the pressing roller 31 through which the recording medium P is conveyed. As illustrated in FIG. 3, both ends of the stationary member 26 in a width direction of the stationary member 26 parallel to an axial direction of the fixing belt 21 are mounted on and supported by the side plates 43 of the fixing device 20, respectively.

As illustrated in FIG. 2, the metal member 22 has a substantially cylindrical shape. The metal member 22 serving as a heating member directly faces the inner circumferential surface 21*a* of the fixing belt 21 at a position other than the nip NP. At the nip NP, the metal member 22 holds the stationary member 26 via the heat insulator 27. As illustrated in FIG. 3, both ends of the metal member 22 in a width direction of the metal member 22 parallel to the axial direction of the fixing belt 21 are mounted on and supported by the side plates 43 of the fixing device 20, respectively. The flanges 29 are provided on both ends of the metal member 22 in the width direction of the metal member 22 to restrict movement (e.g., shifting) of the fixing belt 21 in the axial direction of the fixing belt 21.

The metal member 22 heated by radiation heat generated by the heater 25 heats (e.g., transmits heat to) the fixing belt 21. In other words, the heater 25 heats the metal member 22 directly and heats the fixing belt 21 indirectly via the metal member 22. The metal member 22 may have a thickness not greater than about 0.1 mm to maintain desired heating efficiency for heating the fixing belt 21.

The metal member 22 may include a metal thermal conductor, that is, a metal having thermal conductivity, such as stainless steel, nickel, aluminum, and/or iron. Preferably, the metal member 22 may include ferrite stainless steel having a relatively smaller heat capacity per unit volume obtained by multiplying density by specific heat. According to this exemplary embodiment, the metal member 22 includes SUS430 stainless steel as ferrite stainless steel, and has a thickness of 0.1 mm.

The heater 25, serving as a heater or a heat source, may be a halogen heater and/or a carbon heater. As illustrated in FIG. 3, both ends of the heater 25 in a width direction of the heater 25 parallel to the axial direction of the fixing belt 21 are fixedly mounted on the side plates 43 of the fixing device 20, respectively. Radiation heat generated by the heater 25, which is controlled by a power source provided in the image forming apparatus 1 depicted in FIG. 1, heats the metal member 22. The metal member 22 heats substantially the entire fixing belt 21. In other words, the metal member 22 heats a portion of the fixing belt 21 other than the nip NP. Heat is transmitted from the heated outer circumferential surface of the fixing belt 21 to the toner image T on the recording medium P.

As illustrated in FIG. 2, the temperature sensor 40, which may a thermistor, contacts an inner circumferential face of the metal member 22 to indirectly detect a temperature (e.g., a fixing temperature) of the outer circumferential surface of the fixing belt 21. The controller 10 depicted in FIG. 1 controls the heater 25 according to detection results provided by the temperature sensor 40 so as to adjust the temperature (e.g., a fixing temperature) of the fixing belt 21 to a desired temperature.

In this regard, the configuration and operation of the temperature sensor 40 serving as the temperature detection unit is described later in more detail.

As described above, in the fixing device 20 according to this exemplary embodiment, the metal member 22 having a substantially pipe shape does not heat a small part of the fixing belt 21 but heats substantially the entire fixing belt 21 in a circumferential direction of the fixing belt 21. Accordingly, even when the image forming apparatus 1 depicted in FIG. 1 forms a toner image at high speed, the fixing belt 21 is heated enough to suppress fixing failure. In other words, the relatively simple structure of the fixing device 20 heats the fixing belt 21 efficiently, resulting in a shortened warm-up time, a shortened first print time, and the downsized image forming apparatus 1.

The metal member 22 is disposed opposite the fixing belt 21 in such a manner that a certain clearance A is provided between the inner circumferential surface 21*a* of the fixing belt 21 and the metal member 22 all along the inner surface of the fixing belt 21 except for where the nip NP is formed. The clearance A, that is, a gap between the fixing belt 21 and the metal member 22 at all points along the inner surface of the fixing belt 21 other than the nip NP, is not greater than 1 mm, expressed as $0\ \text{mm} < A \leqq 1\ \text{mm}$. Accordingly, the fixing belt 21 does not slidably contact the metal member 22 over an increased area, thus suppressing wear of the fixing belt 21. At the same time, the clearance is provided between the metal member 22 and the fixing belt 21 is small enough to prevent any substantial decrease in heating efficiency of the metal member 22 for heating the fixing belt 21. Moreover, the metal member 22 disposed close to the fixing belt 21 supports the fixing belt 21 and maintains the circular loop form of the flexible fixing belt 21, thus limiting degradation of and damage to the fixing belt 21 due to deformation of the fixing belt 21.

A lubricant, such as fluorine grease, is applied between the inner circumferential surface 21*a* of the fixing belt 21 and the metal member 22, so as to decrease wear of the fixing belt 21 as the fixing belt 21 slidably contacts the metal member 22.

According to this exemplary embodiment, the metal member 22 has a substantially circular shape in cross-section. Alternatively, the metal member 22 may have a polygonal shape in cross-section or may include a slit along a circumferential surface thereof.

As illustrated in FIG. 2, the reinforcement member 23 reinforces the stationary member 26 which forms the nip NP between the fixing belt 21 and the pressing roller 31. The reinforcement member 23 is fixedly provided inside the loop formed by the fixing belt 21 and faces the inner circumferential surface 21*a* of the fixing belt 21.

As illustrated in FIG. 3, a width of the reinforcement member 23 in a width direction of the reinforcement member 23 parallel to the axial direction of the fixing belt 21, is equivalent to a width of the stationary member 26 in the width direction of the stationary member 26 parallel to the axial direction of the fixing belt 21. Both ends of the reinforcement member 23 in the width direction of the reinforcement member 23 are fixedly mounted on the side plates 43 of the fixing device 20, respectively, in such a manner that the side plates 43 support the reinforcement member 23. As illustrated in FIG. 2, the reinforcement member 23 is pressed against the pressing roller 31 via the stationary member 26 and the fixing belt 21. Thus, the stationary member 26 is not deformed substantially when the stationary member 26 receives pressure applied by the pressing roller 31 at the nip NP.

In order to provide the above-described functions, the reinforcement member 23 includes a metal material having great mechanical strength, such as stainless steel and/or iron. An opposing surface of the reinforcement member 23 which faces the heater 25 may include a heat insulation material partially or wholly. Alternatively, the opposing surface of the reinforcement member 23 disposed opposite the heater 25 may be mirror-ground. Accordingly, heat output by the heater 25 toward the reinforcement member 23 to heat the reinforcement member 23 is used to heat the metal member 22, improving heating efficiency for heating the metal member 22 and the fixing belt 21.

The reinforcement member 23 also serves as a supporting member to support the temperature sensor 40 via the heat insulation member 24, which is described later in more detail.

As illustrated in FIG. 2, the pressing roller 31 serves as a rotary pressing member for contacting and pressing against the outer circumferential surface of the fixing belt 21 at the nip NP. The pressing roller 31 has a loop diameter of about 30 mm. In the pressing roller 31, the elastic layer 33 is provided on the hollow metal core 32. The elastic layer 33 may be silicon rubber foam, silicon rubber, and/or fluorocarbon rubber. A thin release layer including PFA and/or PTFE may be provided on the elastic layer 33 to serve as a surface layer. The pressing roller 31 is pressed against the fixing belt 21 to form the desired nip NP between the pressing roller 31 and the fixing belt 21.

As illustrated in FIG. 3, the gear 45 engaging a driving gear of a driving mechanism is mounted on the pressing roller 31 to rotate the pressing roller 31 clockwise in FIG. 2 in a rotation direction R3. Both ends of the pressing roller 31 in a width direction of the pressing roller 31, that is, in an axial direction of the pressing roller 31, are rotatively supported by the side plates 43 of the fixing device 20 via the bearings 42, respectively. A heat source, such as a halogen heater, may be provided inside the pressing roller 31, but is not necessary.

When the elastic layer 33 of the pressing roller 31 includes a sponge material such as silicon rubber foam, the pressing roller 31 applies decreased pressure to the fixing belt 21 at the nip NP to decrease bending of the metal member 22. Further, the pressing roller 31 provides increased heat insulation, and therefore heat is not transmitted from the fixing belt 21 to the pressing roller 31 easily, improving heating efficiency for heating the fixing belt 21.

According to this exemplary embodiment, the loop diameter of the fixing belt 21 is equivalent to the loop diameter of the pressing roller 31. Alternatively, the loop diameter of the fixing belt 21 may be smaller than the loop diameter of the pressing roller 31. In this case, a curvature of the fixing belt 21 is smaller than a curvature of the pressing roller 31 at the nip NP, and therefore a recording medium P separates from the fixing belt 21 easily when the recording medium P is discharged from the nip NP.

As illustrated in FIG. 4, the inner circumferential surface 21*a* of the fixing belt 21 slides over the stationary member 26. In the stationary member 26, the surface layer 26*a* is provided on the base layer 26*b* and constitutes an opposing surface portion (e.g., a sliding surface portion) of the stationary member 26, which faces the pressing roller 31 has a concave shape corresponding to the curvature of the pressing roller 31. The recording medium P moves along the concave, opposing surface portion of the stationary member 26 corresponding to the curvature of the pressing roller 31, and is discharged from the nip NP. The concave shape facilitates separation of the recording medium P bearing the fixed toner image T from the fixing belt 21.

According to this exemplary embodiment, the stationary member 26 has a concave shape to form the concave nip NP. Alternatively, the stationary member 26 may have a flat, planar shape to form a planar nip NP. Specifically, the sliding surface portion of the stationary member 26 which faces the pressing roller 31 may have a flat, planar shape. Accordingly, the planar nip NP formed by the planar sliding surface portion of the stationary member 26 is substantially parallel to an image side of the recording medium P. Consequently, the fixing belt 21 pressed by the planar sliding surface portion of the stationary member 26 is adhered to the recording medium P precisely to improve fixing property. Further, the increased curvature of the fixing belt 21 at an exit of the nip NP facilitates separation of the recording medium P discharged from the nip NP from the fixing belt 21.

The base layer 26*b* of the stationary member 26 includes a rigid material (e.g., a highly rigid metal or ceramic) so that the stationary member 26 is not bent substantially by pressure applied by the pressing roller 31.

The substantially pipe-shaped metal member 22 may be formed by bending sheet metal into the desired shape. Sheet metal is used to give the metal member 22 a thin thickness to shorten warm-up time. However, such a thin metal member 22 has little rigidity, and therefore is easily bent or deformed by pressure applied by the pressing roller 31. A deformed metal member 22 does not provide a desired nip length of the nip NP, degrading fixing property. To address this problem, according to this exemplary embodiment, the rigid stationary member 26 is provided separately from the thin metal member 22 to help form and maintain the proper nip NP.

As illustrated in FIG. 4, the heat insulator 27 is provided between the stationary member 26 and the heater 25. Specifically, the heat insulator 27 is provided between the stationary member 26 and the metal member 22 in such a manner that the heat insulator 27 covers surfaces of the stationary member 26 other than the sliding surface portion of the stationary member 26 over which the fixing belt 21 slides. The heat insulator 27 includes sponge rubber having desired heat insulation and/or ceramic including air pockets.

The metal member 22 is disposed close to the fixing belt 21 throughout substantially the entire circumference thereof. Accordingly, even in a standby mode before printing starts, the metal member 22 heats the fixing belt 21 in the circumferential direction without temperature fluctuation. Consequently, the image forming apparatus 1 starts printing as soon as the image forming apparatus 1 receives a print request. In conventional on-demand fixing devices, when heat is applied to the deformed pressing roller 31 at the nip NP in the standby mode, the pressing roller 31 may suffer from thermal degradation due to heating of the rubber included in the pressing roller 31, resulting in a shortened life of the pressing roller 31 or permanent compression strain of the pressing roller 31. Heat applied to the deformed rubber increases permanent compression strain of the rubber. The permanent compression strain of the pressing roller 31 makes a dent in a part of the pressing roller 31, and therefore the pressing roller 31 does not provide the desired nip length of the nip NP, generating faulting fixing or noise in accordance with rotation of the pressing roller 31.

To address those problems, according to this exemplary embodiment, the heat insulator 27 is provided between the stationary member 26 and the metal member 22 to reduce heat transmitted from the metal member 22 to the stationary member 26 in the standby mode, suppressing heating of the deformed pressing roller 31 at high temperature in the standby mode.

A lubricant is applied between the stationary member 26 and the fixing belt 21 to reduce sliding resistance between the stationary member 26 and the fixing belt 21. However, the lubricant may deteriorate under high pressure and temperature applied at the nip NP, resulting in unstable slippage of the fixing belt 21 over the stationary member 26. To address this problem, according to this exemplary embodiment, the heat insulator 27 is provided between the stationary member 26 and the metal member 22 to reduce heat transmitted from the metal member 22 to the lubricant at the nip NP, thus reducing deterioration of the lubricant due to high temperature.

The heat insulator 27 provided between the stationary member 26 and the metal member 22 insulates the stationary member 26 from the metal member 22. Accordingly, the metal member 22 heats the fixing belt 21 with reduced heat at the nip NP. Consequently, the recording medium P discharged from the nip NP has a decreased temperature compared to when the recording medium P enters the nip NP. In other words, at the exit of the nip NP, the fixed toner image T on the recording medium P has a decreased temperature, and therefore the toner of the fixed toner image T has a decreased viscosity. Accordingly, an adhesive force which adheres the fixed toner image T to the fixing belt 21 is decreased and the recording medium P is separated from the fixing belt 21. Consequently, the recording medium P is not wound around the fixing belt 21 immediately after the fixing process, preventing or reducing jamming of the recording medium P and adhesion of the toner of the toner image T to the fixing belt 21.

As illustrated in FIG. 4, the stay 28 contacts an inner circumferential surface of a concave portion of the metal member 22 into which the stationary member 26 is inserted so as to hold the metal member 22.

In the present embodiment, a stainless steel sheet having a thickness of about 0.1 mm is bent into the substantially pipe-shaped metal member 22. However, spring-back of the stainless steel sheet may expand a circumference of the metal member 22, and therefore the stainless steel sheet may maintain the desired pipe shape. As a result, the metal member 22 having an expanded circumference may contact the inner circumferential surface of the fixing belt 21, damaging the fixing belt 21 or generating temperature fluctuation of the fixing belt 21 due to uneven contact of the metal member 22 to the fixing belt 21.

To address this problem, according to this exemplary embodiment, the stay 28 supports and holds the concave portion (e.g., a bent portion) of the metal member 22 provided with an opening so as to prevent deformation of the metal member 22 due to spring-back. For example, the stay 28 is press-fitted to the concave portion of the metal member 22 to contact the inner circumferential surface of the metal member 22 while the shape of the metal member 22 that is bent against spring-back of the stainless steel sheet is maintained.

Preferably, the metal member 22 has a thickness not greater than about 0.2 mm to increase heating efficiency of the metal member 22.

As described above, the metal sheet is bent into the substantially pipe-shaped, thin metal member 22 to shorten warm-up time, but lacks the rigidity to withstand deformation due to pressure from the pressing roller 31 and therefore is bent or deformed. Accordingly, the deformed metal member 22 may not provide a desired nip length of the nip NP, resulting in degraded fixing property. To address this problem, according to this exemplary embodiment, the concave portion of the thin metal member 22 into which the stationary member 26 is inserted is spaced away from the nip NP to prevent the metal member 22 from receiving pressure from the pressing roller 31 directly.

Referring to FIGS. 1 and 2, the following describes operation of the fixing device 20 having the above-described structure.

When the image forming apparatus 1 is powered on, power is supplied from a power source to the heater 25, and the pressing roller 31 starts rotating in the rotation direction R3. Friction between the pressing roller 31 and the fixing belt 21 rotates the fixing belt 21 in the rotation direction R2.

Thereafter, a recording medium P is sent from the paper tray 12 to the second transfer nip formed between the intermediate transfer belt 78 and the second transfer roller 89. At the second transfer nip, a color toner image is transferred from the intermediate transfer belt 78 onto the recording medium P. A guide plate guides the recording medium P bearing the toner image T in a direction Y10 so that the recording medium P enters the nip NP formed between the fixing belt 21 and the pressing roller 31 pressed against each other.

At the nip NP, the fixing belt 21 heated by the heater 25 via the metal member 22 applies heat to the recording medium P. Simultaneously, the pressing roller 31 and the stationary member 26 reinforced by the reinforcement member 23 apply pressure to the recording medium P. Thus, the heat applied by the fixing belt 21 and the pressure applied by the pressing roller 31 fix the toner image T on the recording medium P. Thereafter, the recording medium P bearing the fixed toner image T discharged from the nip NP is conveyed in a direction Y11.

The following describes the structure and operation of the fixing device 20 in detail.

As illustrated in FIG. 2, the fixing device 20 according to the first exemplary embodiment includes the temperature sensor 40 serving as a temperature detection unit to contact an inner circumferential surface of the metal member 22 to detect a temperature of the metal member 22.

As illustrated in FIG. 5, the temperature sensor 40 may be a contact-type thermistor including a temperature sensing element (thermistor element) 40*a*, a leaf spring member 40*b*, a holder 40*c*, and a harness 40*d*. The temperature sensing element 40*a* is supported on a free end of the leaf spring member 40*b* made of a metal material. A fixed end of the leaf spring member 40*b* is held by the holder 40*c* made of an electrically insulative, heat-resistant resin material. The holder 40*c* is fixed on a surface of the heat insulation member 24 mounted on the reinforcement member 23. Within the holder 40*c*, the harness 40*d* is electrically connected to the fixed end of the leaf spring member 40*b*. The harness 40*d* is connected to the controller (electronic circuitry). With such a configuration, a spring force of the leaf spring member 40*b* presses the temperature sensing element 40*a* against the inner circumferential surface of the metal member 22, allowing the temperature sensing element 40*a* to detect the temperature of the metal member 22.

In this regard, the present inventors have found that, when the temperature sensor 40 contacts the inner circumferential surface of the metal member 22 with the clearance between the fixing belt 21 and the metal member 22 being not greater than 1 mm in all areas except the fixing nip NP, the temperature sensor 40 is able to detect the surface temperature of the fixing belt 21 with high sensitivity and precision. The reason is that a very small clearance between the fixing belt 21 and the metal member 22 enhances heat conduction responsiveness from the metal member 22 heated by the heater 25 to the fixing belt 21.

Accordingly, as described above, even when the temperature sensor 40 is disposed to contact the inner circumferential surface of the metal member 22, the fixing temperature of the fixing belt 21 can be controlled with high precision as with the configuration in which the temperature sensor contacts the inner circumferential surface of the fixing belt to directly detect the surface temperature of the fixing belt.

In addition, in the fixing device 20 according to the first exemplary embodiment, the temperature sensor 40 contacts the metal member 22 which is irrotational. Such a configuration can relatively suppress abrasion of a contact portion of the temperature sensor 40 that contacts the metal member 22 as compared with a conventional type of fixing device in which a temperature sensor contacts a rotational fixing belt, thereby enhancing durability of the temperature sensor 40.

In the first exemplary embodiment, the reinforcement member 23 also serving as the supporting member to support the temperature sensor 40 is provided between the heater 25 and the temperature sensor 40 to prevent the temperature sensor 40 from being directly heated by the heater (heating unit) 25. Thus, such a configuration can prevent heat damage to or malfunction of the temperature sensor 40. In other words, the temperature sensor 40 is disposed on a first face of the reinforcement member 23 opposite a second face of the reinforcement member 23 facing the heater 25. As described above, in the first exemplary embodiment, the reinforcement member 23 to reinforce the stationary member 26 also serves as the supporting member to support the temperature sensor 40.

Specifically, as illustrated in FIG. 2, the reinforcement member 23 is disposed so as to divide the interior of the metal member 22 into two spaces. Out of the two spaces into which the metal member 22 is divided by the reinforcement member 23, one space downstream of the fixing nip NP in the travel direction of the fixing belt 21 includes the temperature sensor 40 while the other space upstream of the fixing nip NP in the travel direction of the fixing belt 21 includes the heater 25. Thus the temperature sensor 40 is separated from the heater 25 by the reinforcement member 23, thereby reliably preventing the temperature sensor 40 from being directly heated.

In the first exemplary embodiment, the temperature sensor 40 is supported by the reinforcement member 23 via the heat insulation member 24, thereby reliably preventing the temperature sensor 40 from being directly heated by the heater 25. The heat insulation member 24 is made of heat- and electrically insulative material. For example, the heat insulation member 24 includes ceramic including air pockets, sponge rubber having desired heat insulation, and/or other suitable members.

In the first exemplary embodiment, as illustrated in FIG. 5, the heat insulation member 24 made of insulation material is provided with two slits 24*a*. The harnesses 40*d* of the temperature sensor 40 are accommodated within the slits 24*a* of the heat insulation member 24. Even when the harness 40*d* is provided without any electrical-insulation cover layer (typically made of low heat-insulation material), i.e., with metal wires uncovered, the above-described configuration prevents an occurrence of leakage between the harness 40*d* and the reinforcement member 23. Typically, such an electrical-insulation cover layer is made of low heat-insulation material. Accordingly, the above-described configuration is effective because it is undesirable to use a harness with an electrical-insulation cover layer near the metal member 22, which is heated to high temperatures.

In the first exemplary embodiment, the harness 40*d* having no electrical-insulation cover layer is disposed at the temperature sensor 40 and accommodated in the slits 24*a* of the heat insulation member 24 having electrical insulation properties.

Figure 6:
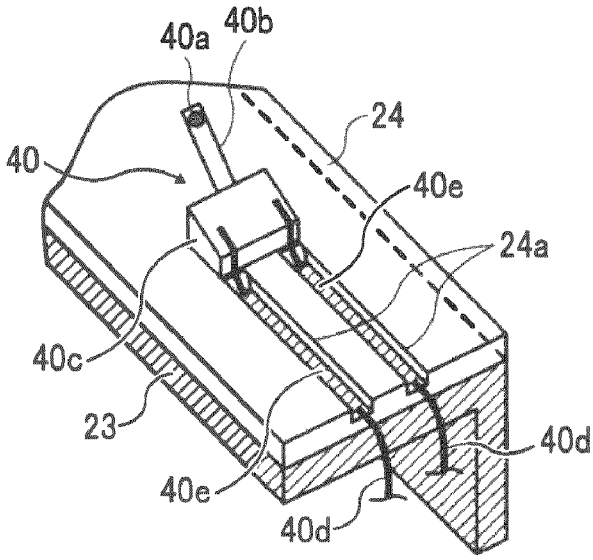
FIG. 6 is a perspective view illustrating another configuration of the temperature sensor shown in FIG. 5.

Alternatively, as illustrated in FIG. 6, electrode patterns 40*e* (electrically connected to the leaf spring member 40*b*) may be provided in the temperature sensor 40, and the electrode patterns 40*e* may be formed in the slits 24*a* of the heat insulation member 24. Further, the temperature sensor 40 may be provided with electrode plates having no electrical-insulation cover layer that is electrically connected to the leaf spring member 40*b*, and the electrode plates may be accommodated in the slits 24*a* of the heat insulation member 24. Such a configuration can prevent an occurrence of leakage between the electrode patterns 40*e* (or the electrode plates) and the reinforcement member 23.

As illustrated in FIG. 2, in the first exemplary embodiment, out of the two spaces into which the interior of the metal member 22 is divided by the reinforcement member 23, one space downstream of the fixing nip NP in the travel direction of the fixing belt 21 includes the temperature sensor 40 while the other space upstream of the fixing nip NP in the travel direction of the fixing belt 21 includes the heater 25.

In operation, the tension of the fixing belt 21 is greater upstream of the fixing nip NP in the travel direction of the fixing belt 21 than downstream of the fixing nip NP in the travel direction of the fixing belt 21. Accordingly, at the upstream side of the fixing nip NP, the clearance between the fixing belt 21 and the metal member 22 is relatively small compared to the downstream side of the fixing nip NP, and the very small clearance set between the fixing belt 21 and the metal member 22 further decreases. In such a configuration, since heat of the metal member 22 is effectively conducted to the fixing belt 21, the heater 25 is disposed in the space at the upstream side of the fixing nip NP.

Meanwhile, at the downstream side of the fixing nip NP, since heat of the fixing belt 21 is removed by a recording medium P passing through the nip, the surface temperature of the fixing belt 21 is reduced. Accordingly, it is necessary to immediately detect such a reduced surface temperature of the fixing belt 21 by the temperature sensor 40 and feed back the detected temperature to the output control of the heater 25. It is for this reason also that the temperature sensor 40 that indirectly detects the surface temperature of the fixing belt 21 is disposed within the space at the downstream side of the fixing nip NP.

As described above, in the first exemplary embodiment, the temperature sensor 40 is disposed in contact with the inner circumferential surface of the metal member 22, and the reinforcement member 23 to support the temperature sensor 40 is provided between the heater 25 and the temperature sensor 40 so that the temperature sensor 40 is not heated by the heater 25. Accordingly, even when the fixing device 20 is driven at high speed with a shortened warm-up time and a shortened first print time, the fixing device 20 does not generate faulty fixing. Further, without upsizing or cost increase, the fixing device 20 can control the fixing temperature with high precision while suppressing abrasive deterioration of the outer circumferential surface of the fixing belt 21.

According to the first exemplary embodiment, a fixing belt having the multi-layer structure is used as the fixing belt 20. Alternatively, an endless fixing film including polyimide, polyamide, fluorocarbon resin, and/or metal may be used as a fixing belt to provide effects equivalent to the effects provided by the fixing device 20 described above.

Figure 7:
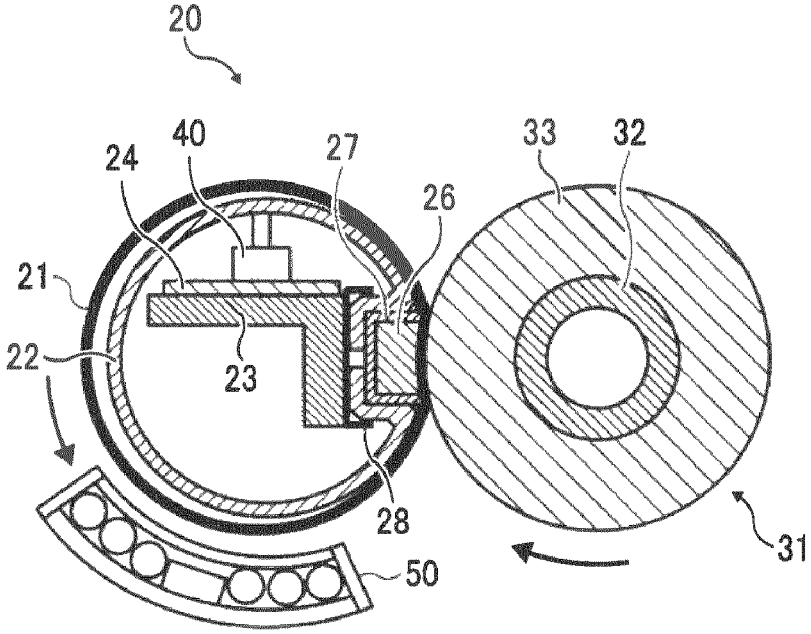
FIG. 7 is a sectional view of a fixing device according to another exemplary embodiment of the present disclosure.

Referring to FIG. 7, the following describes a fixing device 20 according to another exemplary embodiment.

FIG. 7 is a sectional view of the fixing device 20 according to a second exemplary embodiment. The fixing device 20 illustrated in FIG. 7 is different from the fixing device 20 illustrated in FIG. 2 in that the metal member 22 illustrated in FIG. 7 is heated by electromagnetic induction of an induction heater 50, located outside the metal member 22 rather than inside the metal member 22.

As in the fixing device 20 illustrated in FIG. 2, the fixing device 20 illustrated in FIG. 7 includes the fixing belt 21, the stationary member 26, the metal member 22, the pressing roller 31 serving as a rotary pressing member, the temperature sensor 40 serving as a temperature detection unit, the reinforcement member 23 serving as a supporting member, the heat insulation member 24, the heat insulator 27, and the stay 28. Further, in the fixing device 20 illustrated in FIG. 7 as well, the contact-type temperature sensor 40 is disposed so as to contact the inner circumferential surface of the metal member 22 and is supported by the reinforcement member 23 via the heat insulation member 24.

The fixing device 20 includes the induction heater 50 serving as a heater instead of the heater 25 illustrated in FIG. 2. In the fixing device 20 depicted in FIG. 2, radiation heat generated by the heater 25 heats the metal member 22. By contrast, in the fixing device 20 illustrated in FIG. 7, the induction heater 50 heats the metal member 22 by electromagnetic induction.

The induction heater 50 includes an exciting coil, a core, and a coil guide. The exciting coil includes litz wires formed of a bundle of thin wires, which extend in the axial direction of the fixing belt 21 to cover a part of the fixing belt 21. The coil guide includes heat-resistant resin and holds the exciting coil and the core. The core is a semi-cylindrical member including a ferromagnet having a relative magnetic permeability in a range of from about 1,000 to about 3,000, such as ferrite. The core includes a center core and a side core to generate magnetic fluxes toward the metal member 22 effectively. The core is disposed opposite the exciting coil extending in the axial direction of the fixing belt 21.

The following describes operation of the fixing device 20 having the above-described structure.

The induction heater 50 heats the fixing belt 21 rotating in the rotation direction R2 at a position at which the fixing belt 21 faces the induction heater 50. Specifically, a high-frequency alternating current is applied to the exciting coil to generate magnetic lines of force around the metal member 22 in such a manner that the magnetic lines of force are alternately switched back and forth. Accordingly, an eddy current is generated on the surface of the metal member 22, and electric resistance of the metal member 22 generates Joule heat. The Joule heat heats the metal member 22 by electromagnetic induction, and the heated heating member 22 heats the fixing belt 21.

In the fixing device 20 illustrated in FIG. 7, the temperature sensor 40 is separated by a relatively large distance from the induction heater 50 by the reinforcement member 23, thereby reliably preventing the temperature sensor 40 from being directly heated by the induction heater 50. As described above, in the fixing device 20 illustrated in FIG. 7 as well, the temperature sensor 40 is disposed so as to contact the inner circumferential surface of the metal member 22, and the reinforcement member 23 is disposed between the induction heater 50 and the temperature sensor 40 so that the temperature sensor 40 is not directly heated by the induction heater 50. Accordingly, even when the fixing device 20 is driven at high speed with a shortened warm-up time and a shortened first print time, the fixing device 20 does not generate faulty fixing. Further, without upsizing or cost increase, the fixing device 20 can control the fixing temperature with high precision while suppressing abrasive deterioration of the outer circumferential surface of the fixing belt 21.

As described above, in the fixing device 20 according to the second exemplary embodiment, the induction heater 50 heats the metal member 22 by electromagnetic induction. Alternatively, a resistance heat generator may heat the metal member 22. For example, the resistance heat generator may partially contact an inner circumferential surface of the metal member 22. The resistance heat generator may be a sheet-type heat generator such as a ceramic heater, and a power source may be connected to both ends of the resistance heat generator. When an electric current is applied to the resistance heat generator, electric resistance of the resistance heat generator increases a temperature of the resistance heat generator. Accordingly, the resistance heat generator heats the metal member 22 contacted by the resistance heat generator. Consequently, the metal member 22 heated heats the fixing belt 21.

In such a case, as in the above-described exemplary embodiments, the resistance heat generator may be separated from the temperature sensor 40 by the reinforcement member 23 supporting the temperature sensor 40, thereby providing effects equivalent to the effects provided by the above-described exemplary embodiments.

In the above-described exemplary embodiments, the reinforcement member 23 also serves as a supporting member to support the temperature sensor 40, allowing a reduction in the number of components and space saving. Alternatively, when such consideration is not necessary, a supporting member to support the temperature sensor 40 may be provided independent of the reinforcement member.

Numerous additional modifications and variations are possible in light of the above teachings. It is therefore to be understood that within the scope of the appended claims, the present disclosure may be practiced otherwise than as specifically described herein.

With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

For example, elements and/or features of different exemplary embodiments may be combined with each other and/or substituted for each other within the scope of this disclosure and appended claims.

The number, positions, and shapes of the above-described components are not limited to those described in each of the above-described exemplary embodiments and may be any other number, position, and shape suitable for practicing the present disclosure.

What is claimed is:

1. A fixing device comprising:

an endless, flexible fixing member rotatably provided in the fixing device to heat a toner image thereon;

a metal member fixedly mounted in the fixing device so as to be opposite an inner circumferential surface of the fixing member, to maintain the fixing member in a substantially circularly loop shape;

a heater disposed near the metal member to heat the metal member;

a pressing member rotatably pressed against an outer circumferential surface of the fixing member to form a nip portion between the pressing member and the fixing member;

a temperature detector disposed in contact with the metal member, to detect a temperature of the metal member; and a supporting member disposed between the heater and the temperature detector to support the temperature detector.

2. The fixing device according to claim 1, further comprising a stationary member fixedly disposed inside the loop into which the fixing member is formed and maintained by the metal member, with the pressing member pressed against the stationary member via the fixing member to form the nip portion; and a reinforcement member fixedly disposed inside the metal member and opposite the stationary member to reinforce the stationary member.

3. The fixing device according to claim 2, wherein the supporting member separates an interior of the metal member into two spaces, and wherein the temperature detector is disposed in one of the two spaces separated by the supporting member.

4. The fixing device according to claim 3, wherein the heater is disposed in the other of the two spaces into which the supporting member divides the interior of the metal member.

5. The fixing device according to claim 4, wherein the one of the two spaces is disposed downstream of the nip portion in a travel direction of the fixing member and the other of the two spaces is disposed upstream of the nip portion in the travel direction of the fixing member.

6. The fixing device according to claim 2, wherein the supporting member is made of metal and the fixing device further comprises a heat insulation member disposed between the temperature detector and the supporting member.

7. The fixing device according to claim 6, wherein the heat insulation member is made of electrical insulation material.

8. The fixing device according to claim 7, further comprising a temperature detection element, a leaf spring to support the temperature detection element, and a harness having no electrical insulation cover layer and connected to the leaf spring, wherein the heat insulation member has a slit formed in one face thereof to accommodate the harness.

9. The fixing device according to claim 7, further comprising a temperature detection element, a leaf spring to support the temperature detection element, and an electrode pattern having no electrical insulation cover layer and connected to the leaf spring, wherein the heat insulation member has a slit formed in one face thereof to accommodate the electrode pattern.

10. The fixing device according to claim 7, further comprising a temperature detection element, a leaf spring to support the temperature detection element, and an electrode plate having no electrical insulation cover layer and connected to the leaf spring, wherein the heat insulation member has a slit formed in one face thereof to accommodate the electrode plate.

11. The fixing device according to claim 1, wherein a clearance between the metal member and the fixing member is not greater than 1 millimeter in an area except the nip portion.

12. The fixing device according to claim 1, wherein the metal member has a substantially cylindrical pipe.

13. An image forming apparatus comprising a fixing device, the fixing device comprising:

an endless, flexible fixing member rotatably provided in the fixing device to heat a toner image thereon;

a metal member fixedly mounted in the fixing device so as to be opposite an inner circumferential surface of the fixing member, to maintain the fixing member in a substantially circularly loop shape;

a heater disposed near the metal member to heat the metal member;

a pressing member rotatably pressed against an outer circumferential surface of the fixing member to form a nip portion between the pressing member and the fixing member;

a temperature detector disposed in contact with the metal member, to detect a temperature of the metal member; and a supporting member disposed between the heater and the temperature detector to support the temperature detector.

* * * * *